US007918587B2

(12) United States Patent
Hsu et al.

(10) Patent No.: US 7,918,587 B2
(45) Date of Patent: Apr. 5, 2011

(54) LED FIXTURE AND MASK STRUCTURE THEREOF

(75) Inventors: Zu-Chao Hsu, Taipei (TW); Chih-Wei Chen, Taipei (TW)

(73) Assignee: Chaun-Choung Technology Corp., Taipei (TW)

( * ) Notice: Subject to any disclaimer, the term of this patent is extended or adjusted under 35 U.S.C. 154(b) by 208 days.

(21) Appl. No.: 12/265,384

(22) Filed: Nov. 5, 2008

(65) Prior Publication Data

US 2010/0110691 A1 May 6, 2010

(51) Int. Cl.
*F21V 29/00* (2006.01)

(52) U.S. Cl. ..... 362/294; 362/373; 165/104.33; 165/185; 313/11; 313/45; 361/703; 361/709; 361/710

(58) Field of Classification Search ..... 362/218, 362/294, 373; 313/11, 45; 165/104.33, 182, 165/185; 361/703, 709, 710
See application file for complete search history.

(56) References Cited

U.S. PATENT DOCUMENTS 2,419,234 A * 4/1947 Holihan ..... 165/185
7,753,106 B2 * 7/2010 Lin et al. ..... 165/185

* cited by examiner

*Primary Examiner* — Stephen F Husar
(74) *Attorney, Agent, or Firm* — Chun-Ming Shih; HDLS IPR Services

(57) ABSTRACT

An LED fixture include a mask structure and an LED module. The mask structure includes a cooling fin set of buckling type, an upper socket and a lower socket. The cooling fin set is constituted by a plurality of cooling fins that are encircled and inter-buckled to each other. An interior enclosed by the cooling fin set is formed into an accommodating space and a fitting hole connecting the accommodating space. The upper socket is assembled to one side of the fitting hole, while the lower socket is assembled to another side of the fitting hole. Meanwhile, the upper socket and the lower socket are respectively fastened by the cooling fin set through a clipping-and-abutting manner. The LED module is arranged by accommodating in the accommodating space and is connected to the cooling fin set as well. Accordingly, the entirely cooling effectiveness is promoted and the using lifetime is prolonged.

20 Claims, 6 Drawing Sheets

LED FIXTURE AND MASK STRUCTURE THEREOF

BACKGROUND OF THE INVENTION

1. Field of the Invention

The present invention in general relates to an LED fixture, in particular, to an LED fixture with a mask structure, and to the mask structure itself.

2. Description of Prior Art

Following technology's continuous development and progress, electronic elements have being developed toward a trend of small size and lightweight. Taking LED as example, since of many merits such as superior illumination, longer lifetime, more power conservation and environmental friendliness, LED has being comprehensively applied by the industries in the fields of indoor and outdoor illuminating devices. However, the most notable factor influencing the using lifetime of LED is the working atmosphere of appropriate temperature, under which the LEDs can be operated with an optimal performance. Accordingly, the inventor takes LED's cooling as a studying issue for the present case.

The LED fixture according to prior arts mainly includes a mask structure and an LED module. The mask structure includes an aluminum-extruded cooling seat and an optical lens covering the cooling seat. While an accommodating space is arranged at the central area of the cooling seat, the LED module is arranged by accommodating in the accommodating space and adhered to the cooling seat. The LED includes a circuit board adhered to the cooling seat and a plurality of LED lamps electrically connected to the circuit board. Thereby, an assembled LED fixture is thus obtained.

However, in terms of practical application, the LED fixtures according to the prior arts still have several shortcomings needed to be solved. First, since the cooling seat is manufactured from an aluminum-excluded process, a slower cooling speed is thus provided. Second, since the cooling area of the cooling seat is limited by the size of its area, the cooling effectiveness is so limited that the cooling performance of the LED lamps is therefore influenced.

After a substantially devoted study, in cooperation with the application of relatively academic principles, the inventor has finally proposed the present invention that is designed reasonably to possess the capability to improve the prior arts significantly.

SUMMARY OF THE INVENTION

The invention is mainly to provide an LED fixture and a mask structure thereof. Through a cooling fin set constituted by a plurality of cooling fins that are encircled and interlocked to each other, the effectively cooling area is increased, the entirely cooling performance is promoted and the using lifetime of the LED lamp is prolonged.

Secondly, the invention is to provide an LED fixture constituted by a mask structure and an LED module. In the invention, the mask structure includes a cooling fin set, an upper socket and a lower socket. The cooling fin set is constituted by a plurality of cooling fins that are encircled and interlocked to each other. An interior enclosed by the cooling fin set is formed into an accommodating space and a fitting hole connecting the accommodating space. The upper socket is assembled to one side of the fitting hole, while the lower socket is assembled to another side of the fitting hole. The upper socket and the lower socket are respectively fastened by the cooling fin set. The LED module is arranged by accommodating in the accommodating space and is connected to the cooling fin set as well.

Thirdly, the invention also provides a mask structure of LED fixture, which includes a cooling fin set, an upper socket and a lower socket. The cooling fin set is constituted by a plurality of cooling fins that are encircled and interlocked to each other. An interior enclosed by the cooling fin set is formed into an accommodating space and a fitting hole connecting the accommodating space. The upper socket is assembled to one side of the fitting hole, while the lower socket is assembled to another side of the fitting hole. The upper socket and the lower socket are respectively fastened by the cooling fin set.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, not used to limit its executing scope. Any equivalent variation and modification made according to appended claims is all covered by the claims claimed by the present invention.

Figure 1:
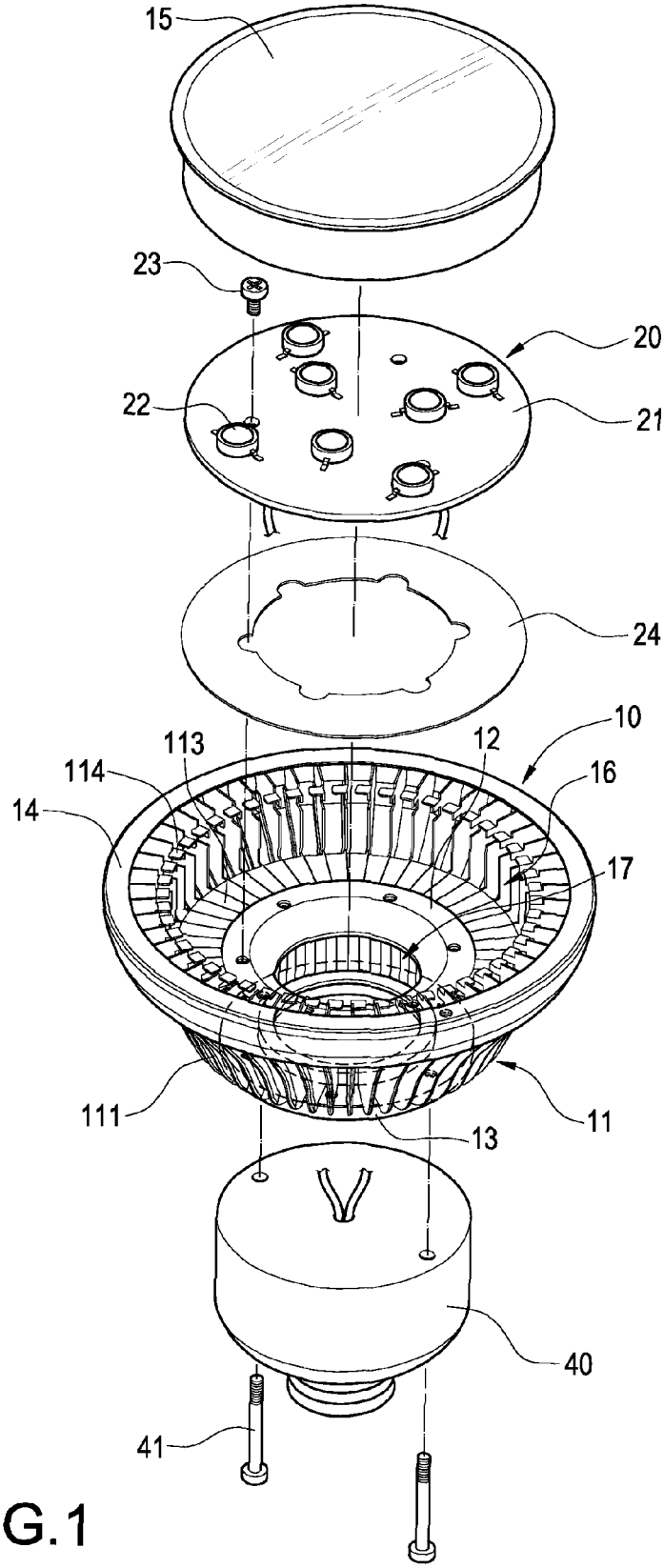
FIG. 1 is a perspective explosive illustration of the invention.
Figure 2:
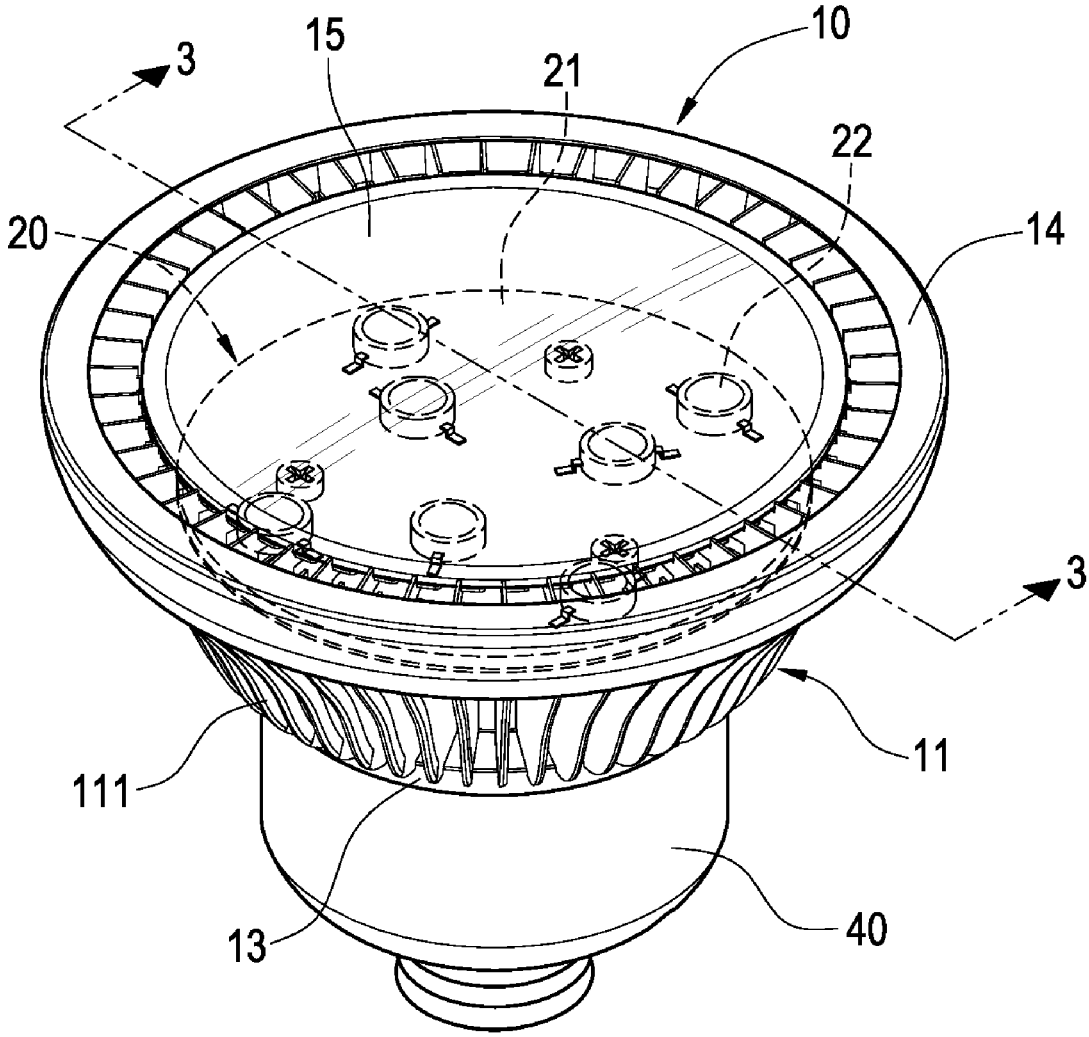
FIG. 2 is a perspective assembled illustration of the invention.
Figure 3:
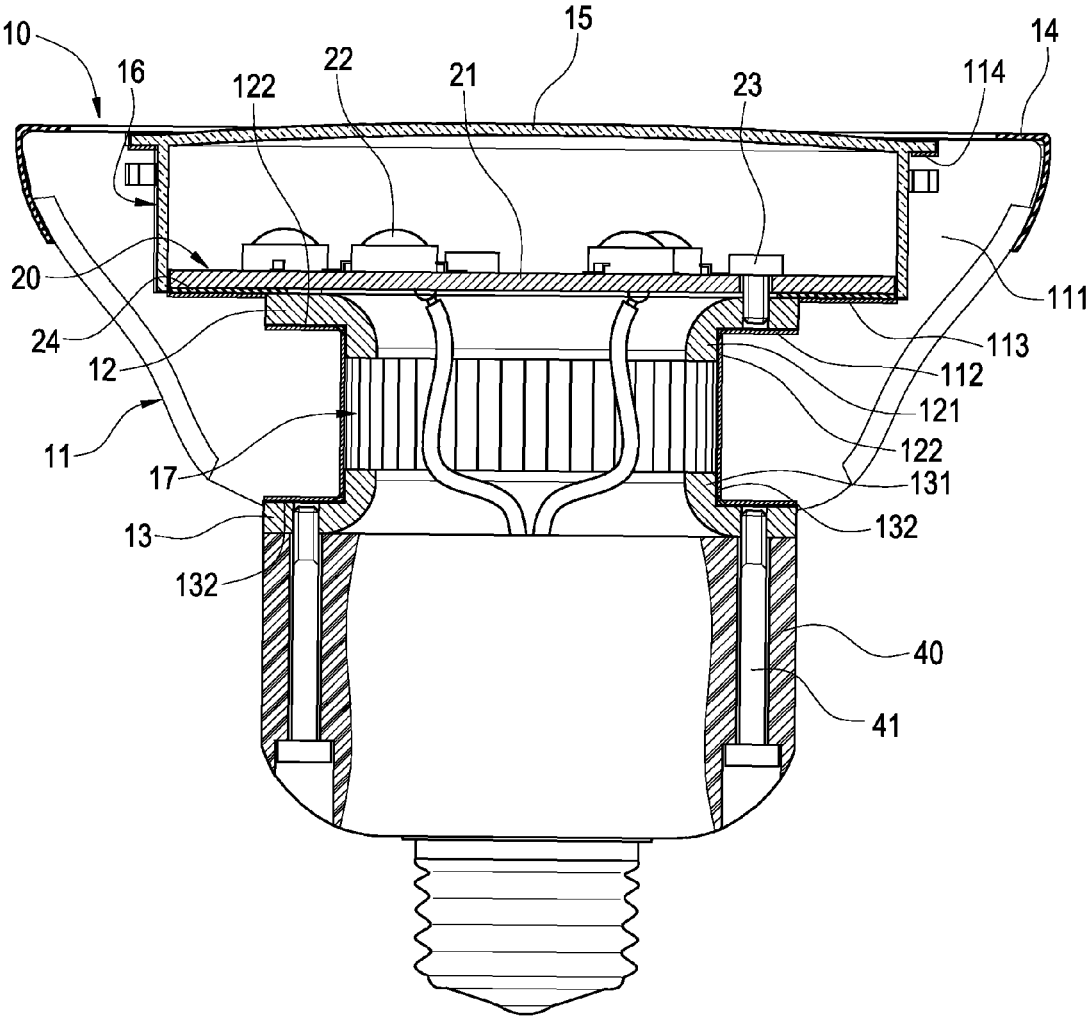
FIG. 3 is an illustration of "3-3" section in FIG. 2.

Please refer to FIG. 1 to FIG. 3, showing that the LED fixture of the invention is constituted by a mask structure 10 and an LED module 20.

The mask structure 10 includes a cooling fin set 11, an upper socket 12, a lower socket 13, a fastening ring 14 and an optical lens 15.

Figure 4:
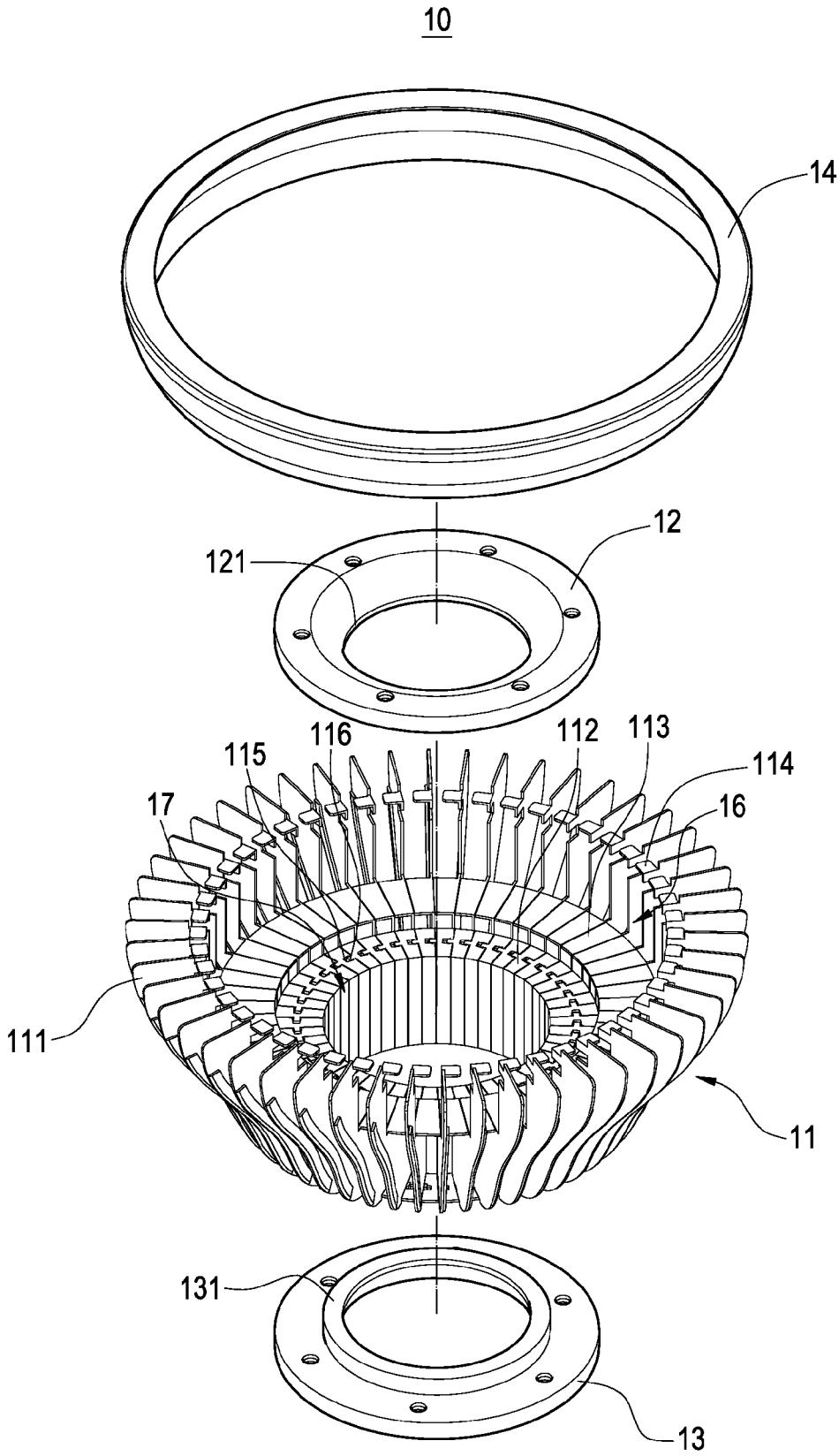
FIG. 4 is a perspective illustration of the mask structure of the invention.
Figure 6:
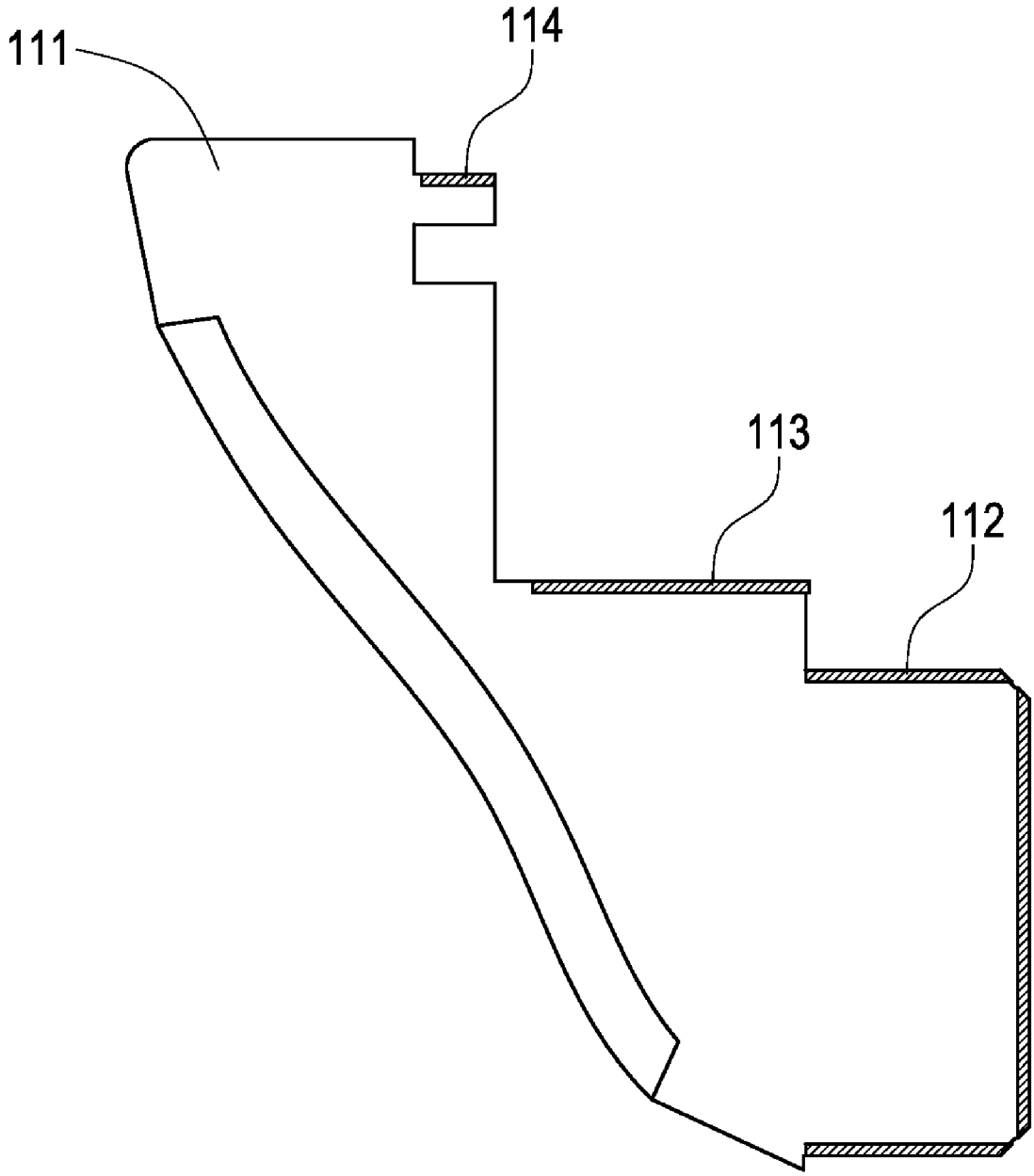
FIG. 6 is a plane illustration of the cooling fin of the invention.

The cooling fin set 11 is constituted by a plurality of cooling fins 111 that are encircled and interlocked to each other. An inside of any cooling fin 111 is shown as a ladder configuration. An interior enclosed by the cooling fins 111 is formed into an accommodating space 16 and a fitting hole 17 connecting the accommodating space 16 (as shown in FIG. 4). An inside size of the accommodating space 16 can be larger than an inside size of the fitting hole 17. In this case, the inside of the cooling fin 111 is a three-sectional junction constituted by a first junction 112, a second junction 113 and a third junction 114, as shown in FIG. 6. The insides of any two neighboring cooling fins 111 are respectively arranged a snap trough 115 and configured a snap hook 116 correspondingly to be connected to the snap trough 115 by snapping therein. In other words, the snap hook 116 of any cooling fin 111 can be fastened to the snap trough 115 of another cooling fin 111 by means of snapping manner.

Figure 5:
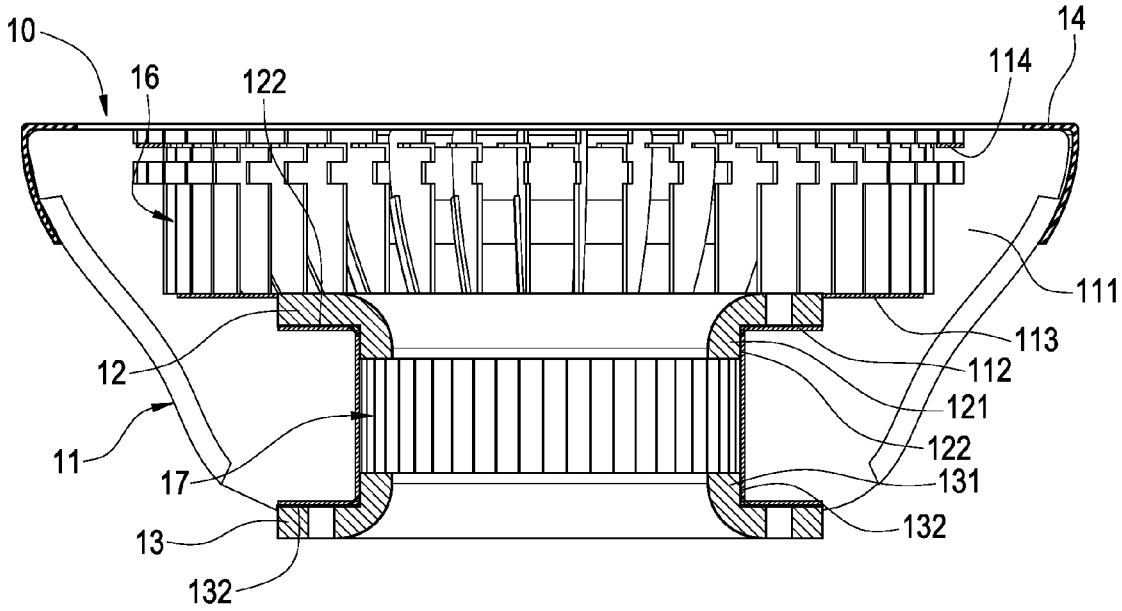
FIG. 5 is an assembled sectional view of FIG. 4.

The upper socket 12 shown as a ring configuration is assembled at one side of the fitting hole 17. An inside of the ring is extended a projecting wall 121 arranged by fitting to one side of the fitting hole 17. On one hand, the ring is fastened by connecting to the first junction 112. On the other hand, a first thermally conductive medium 122 is arranged between the upper socket 12 and the first junction 112 and between the projecting wall 121 and the fitting hole 17, as shown in FIG. 5. The first thermally conductive medium 122 can be a thermally conductive adhesive or a thermally conductive grease.

The lower socket 13 is assembled to another side of the fitting hole 17 by connecting thereto. The upper socket 12 and the lower socket 13 are respectively fastened to the cooling fin set 11. The lower socket 13 is shown as a ring configuration, an inside of which is extended a projecting ring 131 fitted and connected to another side of the fitting hole 17. A second thermally conductive medium 132 is arranged between the lower socket 13 and the cooling fin set 11 and between the projecting ring 131 and the fitting hole 17, as shown in FIG. 5. The second thermally conductive medium 132 can be a thermally conductive adhesive or a thermally conductive grease.

The fastening ring 14 is arranged at an outer circumference of the cooling fin set 11 by fitting thereto, thereby the cooling fin set 11 being bound and fastened.

The optical lens 15 covers one side of the cooling fin set 11 by fitting thereto and is fastened onto the third junction 114 as well. In addition, an adhesive (not shown in the figures) is arranged between the optical lens 15 and the third junction 114, making the optical lens 15 fastened to the cooling fin set 11. The adhesive can be a glue or a self-adhesive.

Again, please refer to FIG. 3. In this case, the LED module 20 is accommodated in the accommodating space 16 and adhered to the cooling fin set 11. The LED module 20 includes a circuit board 21 connected to the cooling fin set 11 and at least one LED lamp 22 electrically connected to the circuit board 21. On one hand, the circuit board 21 is fastened onto the second junction 113. On the other hand, the connection between the circuit board 21 and the upper socket 12 can be made by locking up through a plurality of screws 23. The locking up manner belongs to prior techniques, so no repetitious description is presented herein. The LED lamp 22 is arranged by corresponding to the optical lens 15. The LED lamp 22 can be an LED of high power or constituted by a plurality of LEDs.

In this embodiment, the LED module further includes a thermal conductor 24 clipped and abutted between the circuit board 21 and the second junction 113 of the cooling fin set 11. The thermal conductor 24 can prevent an electric contact between the circuit board 21 and the cooling fin set 11, also avoiding the circuit board 21 from an occurrence of short circuit. The thermal conductor 24 can be a thermally conductive silica gel, a thermally conductive adhesive or a thermally conductive piece, which are electric insulators possessing excellent thermal conductive performance.

In this embodiment, the invention further includes an electric connector 40 connected the lower socket 13 and electrically connected the LED module 20. On one hand, the electric connector 40 is electrically connected the circuit board 21 of the LED module 20. On the other hand, the connection between the electric connector 40 and the lower socket 13 can be made by locking up through a plurality of screws 41. The locking up manner belongs to prior techniques, so no repetitious description is presented herein.

When the invention is assembled, as shown in FIG. 2 and FIG. 3, the cooling fins 11 are first connected by buckling up to each other, such that the cooling fin set 11 is assembled. Then, the upper and lower sockets 12, 13 are separately abutted against the upper and lower hole walls in the fitting hole 17. Next, the fastening ring 14 is arranged by fitting to the outer circumference of one side of the cooling fin set 11. In sequence, the thermal conductor 24 and the LED module 20 are placed onto the second junction 113. By the plural screws 23, the circuit board 21 of the LED module 20 is locked up onto the upper socket 12. After the optical lens 15 is fastened onto the third junction 114, the electric connector 40 is locked up to a bottom side of the lower socket 13 by the plural screws 41. Finally, an assembly procedure of the invention is thereby completed.

Please refer to FIG. 3. When the invention is used, electricity first passes through the LED module, which then generates optical energy and thermal energy. The optical energy emits light by passing through the optical lens 15, while the thermal energy is conducted to the thermally conductive fin set 11 by passing through the circuit board 221, the thermal conductor 24 and the upper socket 12. Since the cooling fins 111 quickly dissipate the thermal energy generated by the LED module 20, an excellently cooling effectiveness is achieved and the using lifetime of the LED lamp is prolonged.

Summarizing aforementioned description, because applying the invention can increase the effective area of heat dissipation, a further promotion of the entirely cooling performance can be made, the using lifetime of LED lamp 22 is prolonged and each shortcoming of the prior art is solved, the invention indeed possesses a high value of industrial application.

What is claimed is:

1. An LED fixture, including:

a mask structure, including:

a cooling fin set, which is constituted by a plurality of cooling fins that are encircled and interlocked to each other, and an interior enclosed by which is formed into an accommodating space and a fitting hole connecting the accommodating space;

an upper socket, which is assembled to one side of the fitting hole; and a lower socket, which is assembled to another side of the fitting hole, meanwhile, the upper socket and the lower socket being respectively fastened by the cooling fin set; and an LED module, which is arranged by accommodating in the accommodating space and is connected to the cooling fin set as well.

2. The LED fixture according to claim 1, wherein an inside of any cooling fin is shown as a ladder configuration.

3. The LED fixture according to claim 1, wherein an inside size of the accommodating space is larger than an inside size of the fitting hole.

4. The LED fixture according to claim 1, wherein the upper socket is designed as a ring configuration, an inside of which is extended a projecting wall fitted at the one side of the fitting hole.

5. The LED fixture according to claim 1, wherein the lower socket is designed as a ring configuration, an inside of which is extended a projecting ring fitted at the another side of the fitting hole.

6. The LED fixture according to claim 1, wherein the mask structure further includes a thermally conductive medium for a connection between the upper socket and the fitting hole.

7. The LED fixture according to claim 6, wherein the thermally conductive medium is a thermally conductive adhesive or a thermally conductive grease.

8. The LED fixture according to claim 1, wherein the mask structure further includes a thermally conductive medium for a connection between the lower socket and the fitting hole.

9. The LED fixture according to claim 1, wherein the LED module includes a circuit board adhered to the cooling fin set and at least one LED lamp electrically connected to the circuit board.

10. The LED fixture according to claim 9, wherein the LED module further includes a thermal conductor clipped and abutted between the circuit board and the cooling fin set.

11. The LED fixture according to claim 9, wherein the mask structure further includes an optical lens connected to one side of the cooling fin set, and wherein the LED lamp is arranged corresponding to the optical lens.

12. A mask structure of LED fixture, including:

a cooling fin set, which is constituted by a plurality of cooling fins that are encircled and interlocked to each other, and an interior enclosed by which is formed into an accommodating space and a fitting hole connecting the accommodating space;

an upper socket, which is assembled to one side of the fitting hole;

a lower socket, which is assembled to another side of the fitting hole, meanwhile, the upper socket and the lower socket being respectively fastened by the cooling fin set; and a thermally conductive medium being a thermally conductive adhesive or a thermally conductive grease.

13. The mask structure of LED fixture according to claim 12, wherein an inside of any cooling fin is shown as a ladder configuration.

14. The mask structure of LED fixture according to claim 12, wherein an inside size of the accommodating space is larger than an inside size of the fitting hole.

15. The mask structure of LED fixture according to claim 12, wherein the upper socket is designed as a ring configuration, an inside of which is extended a projecting wall fitted at one side of the fitting hole.

16. The mask structure of LED fixture according to claim 12, wherein the lower socket is designed as a ring configuration, an inside of which is extended a projecting ring fitted at another side of the fitting hole.

17. The mask structure of LED fixture according to claim 12, wherein the thermally conductive medium is for a connection between the upper socket and the fitting hole.

18. The mask structure of LED fixture according to claim 12, wherein the thermally conductive medium is for a connection between the lower socket and the fitting hole.

19. The mask structure of LED fixture according to claim 12, wherein the mask structure further includes an optical lens connected to one side of the cooling fin set.

20. A mask structure of LED fixture, including:

a cooling fin set, which is constituted by a plurality of cooling fins that are encircled and interlocked to each other, and an interior enclosed by which is formed into an accommodating space and a fitting hole connecting the accommodating space;

an upper socket, which is assembled to one side of the fitting hole;

a lower socket, which is assembled to another side of the fitting hole, meanwhile, the upper socket and the lower socket being respectively fastened by the cooling fin set; and an optical lens connected to one side of the cooling fin set.

* * * * *